US005179367A

United States Patent [19]

Shimizu

[11] Patent Number: 5,179,367

[45] Date of Patent: Jan. 12, 1993

[54] SUSPENDED DISPLAY APPARATUS

[75] Inventor: Hiroaki Shimizu, Kanagawa, Japan

[73] Assignee: Stanley Electric Co., Ltd., Tokyo, Japan

[21] Appl. No.: 557,780

[22] Filed: Jul. 26, 1990

[30] Foreign Application Priority Data

Sep. 6, 1989 [JP] Japan ..... 1-104691[U]

[51] Int. Cl.[5] ..... G09G 1/00

[52] U.S. Cl. ..... 340/700; 248/317; 248/323; 248/919; 248/922

[58] Field of Search ..... 40/617; 248/317, 323, 248/916, 917, 918, 919, 920-924; 312/245; 340/783, 700; 403/61, 116, 375, 408.1; 411/400, 539; 362/190, 191, 269, 270, 282, 285, 287, 365, 368, 371, 382, 391, 396, 404, 406

[56] References Cited

U.S. PATENT DOCUMENTS

| | | | |
|---|---|---|---|
| 978,218 | 12/1910 | Sargent | 40/617 |
| 1,009,409 | 11/1911 | Harding | 40/617 |
| 2,626,175 | 1/1953 | Jessop | 248/317 |
| 4,471,931 | 9/1984 | Covey et al. | 362/269 |
| 4,566,663 | 1/1986 | Barchus | 248/921 |
| 4,964,606 | 10/1990 | Beam et al. | 248/919 |

*Primary Examiner*—Jeffery A. Brier
*Assistant Examiner*—Jick Chin
*Attorney, Agent, or Firm*—Nixon & Vanderhye

[57] ABSTRACT

In a suspended display apparatus suspended from a predetermined position, a display panel is supported substantially vertically by a front face of a case. A hook arrangement is mounted to an upper face of the case such that the hook arrangement is movable toward and away from the front face of the case. An elongated suspending arrangement has one end thereof fixedly mounted to the predetermined position. The other end of the elongated suspending arrangement is engaged with the hook arrangement.

6 Claims, 4 Drawing Sheets

SUSPENDED DISPLAY APPARATUS

BACKGROUND OF THE INVENTION

The present invention relates to suspended display apparatuses comprising LEDs (light-emitting diodes), liquid crystal elements or the like used as various displays or the like and, more particularly, to a suspended display apparatus particularly high in visuality.

The conventional suspended display apparatus has been constructed as shown, for example, in FIGS. 12 and 13 of the attached drawings.

As shown in FIGS. 12 and 13, a suspended display apparatus 1 comprises a case 2 and a display panel 3 which is supported substantially vertically by a front side or face of the case 2. The case 2 has its upper face at which a pair of hook units 4 and 4 are provided. A pair of elongated suspending elements or chains 6 and 6 have their respective one ends which are fixedly mounted to their respective predetermined positions on the ceiling 5 or the like. The other ends of the respective chains 6 and 6 are engaged respectively with or hooked respectively on the hook units 4 and 4. In this manner, the suspended display apparatus 1 is suspended from the ceiling 5 and is mounted in position.

By the way, the suspended display apparatus 1 constructed as described above is suspended in such an inclined manner that the front face of the display panel 3 is generally directed slightly downwardly as indicated by the arrow in FIG. 12 in order to make display on the display panel 3 easy in view. Since, however, the hook units 4 and 4 are fixedly mounted to the upper face of the case 2, the inclined angle of the suspended display apparatus 1 is uniquely determined on the basis of the position of the center of gravity G of the suspended display apparatus 1, and it is impossible to adjust the inclined angle subsequently.

Particularly, in the case where the display panel 3 comprises liquid crystal elements, the following problem arises. That is, since a visual angle is narrow at which display on the display panel 3 is capable of being viewed, even if it is confirmed that display on the display panel 3 is difficult in view after the suspended display apparatus 1 has been mounted to the ceiling 5, the inclined angle of the display panel 3 cannot be adjusted. Thus, in order to alter or modify the mounting positions of the respective hook units 4 and 4 to the upper face of the case 2, it is necessary that the hook units 4 and 4 are once detached from the upper face of the case 2 and, subsequently, are again mounted, in their respective proper positions, to the upper face of the case 2.

SUMMARY OF THE INVENTION

It is therefore an object of the invention to provide a suspended display apparatus capable of being easily viewed in display, in which, even after having been suspended from a predetermined position, it is possible to adjust an inclined angle of a display panel.

According to the invention, there is provided a suspended display apparatus suspended from a predetermined position, comprising:

a case having a front face and an upper face;

a display panel supported substantially vertically by the front face of the case;

hook means mounted to the upper face of the case such that the hook means is movable toward and away from the front face of the case; and elongated suspending means having one end thereof fixedly mounted to the predetermined position, the other end of the elongated suspending means being engaged with the hook means.

With the arrangement of the invention, the hook means is first fixedly mounted provisionally to a suitable position on the upper face of the case and, subsequently, the other end of the elongated suspending means having its one end fixedly mounted to the predetermined position is engaged with the hook means, to suspend the suspended display apparatus from the predetermined position. An inclined state or condition of the display panel is confirmed. Then, the hook means is moved on the upper face of the case toward and away from the front face thereof, whereby the hook means is adjusted in position. Subsequently, the hook means is fixedly mounted to the upper face of the case. Thus, it is made possible to adjust the display panel to a desirable inclined angle.

Accordingly, display on the display panel is made easy in view. Particularly, in the case where the display panel comprises liquid crystal elements, there is obtained display further high in visuality.

Thus, according to the invention, there is provided the suspended display apparatus in which, even after having been suspended from the predetermined position, it is possible to adjust the inclined angle of the display panel, so that the display can easily be viewed.

DESCRIPTION OF THE EMBODIMENTS

Figure 1:
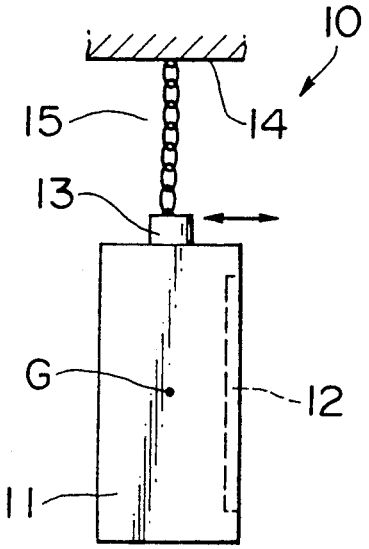
FIG. 1 is a schematic side elevational view of a suspended display apparatus according to an embodiment of the invention.
Figure 2:
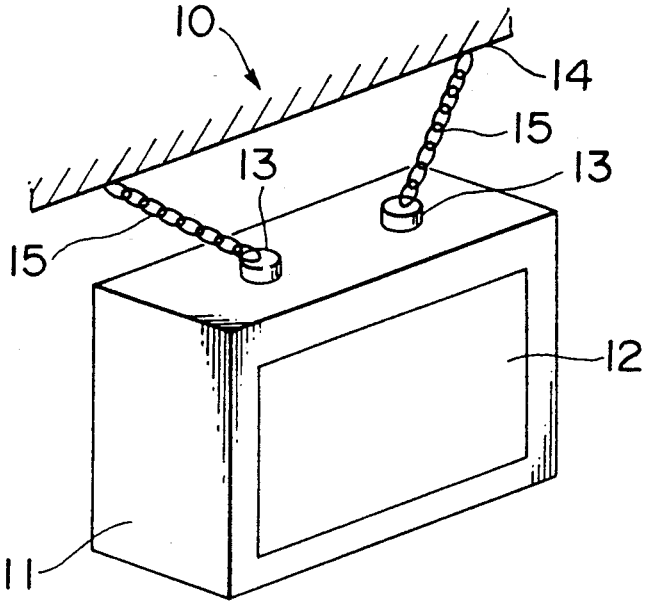
FIG. 2 is a perspective view of the suspended display apparatus illustrated in FIG. 1.

Referring first to FIGS. 1 and 2, there is shown a suspended display apparatus 10 according to an embodiment of the invention.

The suspended display apparatus 10 comprises a case 11 and a display panel 12 which is supported substantially vertically by a front side or face of the case 11.

The case 11 has its upper face at which a pair of hook units 13 and 13 are provided. Each of a pair of elongated suspending elements or chains 15 and 15 has its one end which is fixedly mounted to a predetermined position on the ceiling 14 or the like. The other end of the chain 15 is formed by an annular element which is engaged with or hooked on the hook unit 13. In this manner, the suspended display apparatus 10 is suspended from the ceiling 14 and is mounted in position.

Figure 12:
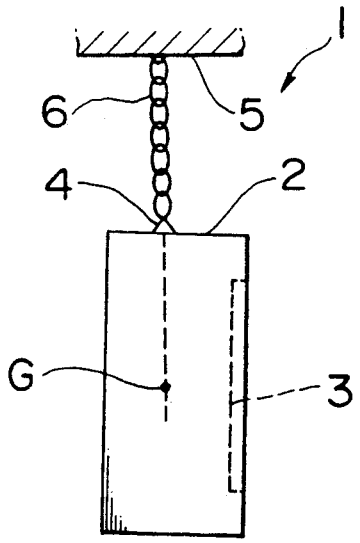
FIG.12 Prior Art
FIG. 12 is a schematic side elevational view of an example of the conventional suspended display apparatus.
Figure 13:
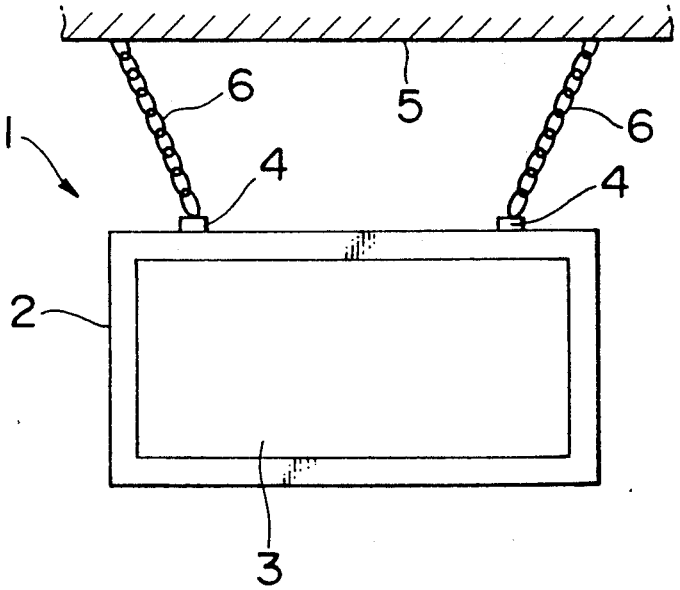
FIG.13 Prior Art
FIG. 13 is a schematic front elevational view of the suspended display apparatus illustrated in FIG. 12.

The above-described construction is similar to that of the conventional suspended display apparatus 1 illustrated in FIGS. 12 and 13. In the suspended display apparatus 10 according to the embodiment of the invention, however, the pair of hook units 13 and 13 are mounted to the upper face of the case 11 so as to be capable of being moved and adjusted on the upper face of the case 11 longitudinally, i.e., toward and away from the front face of the case 11.

The suspended display apparatus 10 according to the embodiment of the invention is constructed as mentioned above. In the case where the suspended display apparatus 10 is suspended from the ceiling 14, the pair of hook units 13 and 13 are fixedly mounted provisionally to their respective suitable positions on the upper face of the case 11 and, subsequently, the other ends of the respective chains 15 and 15, whose respective one ends are fixedly mounted, in their respective predetermined positions, to the ceiling 14, are hooked respectively on the pair of hook units 13 and 13, whereby the suspended display apparatus 10 is suspended from the predetermined positions such as the ceiling 14.

Here, the inclined state or condition of the display panel 12 of the suspended display apparatus 10 is confirmed. The pair of hook units 13 and 13 are moved on the upper face of the case 11 toward and away from the front face thereof so that the pair of hook units 13 and 13 are adjusted in their respective positions. Under such condition, the pair of hook units 13 and 13 are fixedly mounted to the upper face of the case 11. By doing so, it is possible to adjust the display panel 12 to its desirable inclined angle.

Specifically, if it is desired to direct or orient the display panel 12 further downwardly, the pair of hook units 13 and 13 are moved on the upper face of the case 11 away from the front face thereof. On the other hand, it is desired to direct the display panel 12 further upwardly, the pair of hook units 13 and 13 are moved on the upper face of the case 11 toward the front face thereof. By doing so, the inclined angle of the display panel 12 can be adjusted to a desirable angle on the basis of the positional relationship between the pair of hook units 13 and 13 and the center of gravity G of the suspended display apparatus 10.

Figure 3:
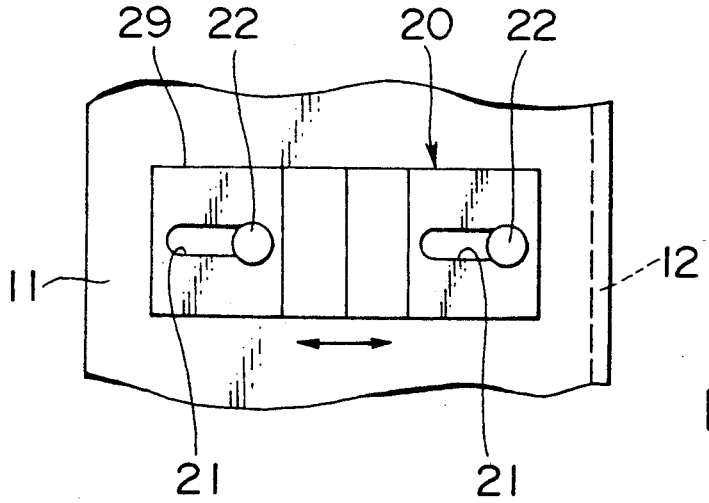
FIG. 3 is a fragmentary enlarged top plan view of a specific constitutional example of one of a pair of hook units of the suspended display apparatus illustrated in FIGS. 1 and 2.
Figure 4:
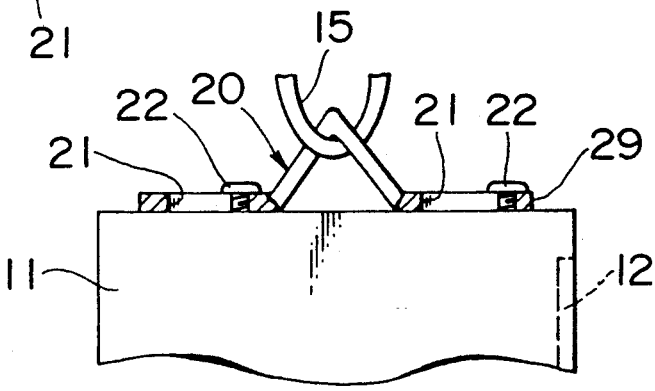
FIG. 4 is a fragmentary side elevational view of the hook unit illustrated in FIG. 3.

FIGS. 3 and 4 show a specific constitutional example of each of the pair of hook units 13 and 13 of the suspended display apparatus 10.

As shown in FIGS. 3 and 4, a hook unit 20 comprises a hook element 29 whose central or intermediate section is bent away from the upper face of the case 11, i.e., is formed into an inverted V-shaped configuration. The chain 15 has its lower end which is engaged with the V-shaped intermediate section of the hook element 29, as shown in FIG. 4. The hook element 29 is formed therein with a pair of mounting bores 21 and 21 to the case 11, which are formed respectively into elongated bores extending in a direction perpendicular to the front face of the case 11.

The hook element 29 is engaged with the upper face of the case 11 by the use of a pair of mounting screws 22 and 22. Under such a condition that the mounting screws 22 and 22 are loosened, however, the mounting screws 22 and 22 can slidingly moved relatively along the respective mounting bores 21 and 21, whereby the hook element 20 can be moved with respect to the case 11 toward and away from the front face thereof. The mounting screws 22 and 22 are tightened at their respective suitable positions, whereby the hook element 29 is fixedly mounted to the upper face of the case 11 at an optional and desirable position. Thus, the chain 15 is mounted to the hook unit 20 whereby there is obtained a desirable inclined angle of the display panel 12 of the suspended display apparatus 10.

Figure 5:
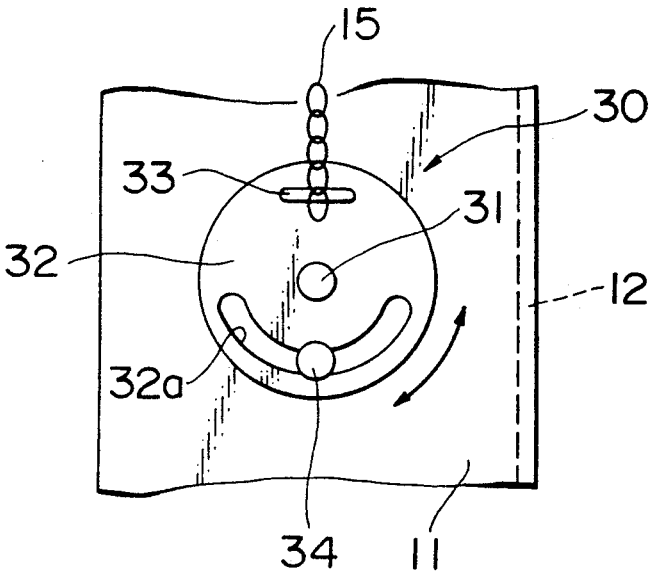
FIG. 5 is a view similar to FIG. 3, but showing another constructional example of the hook unit.
Figure 6:
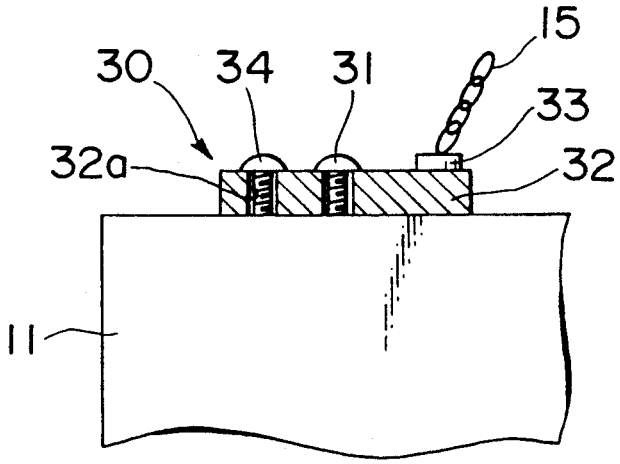
FIG. 6 is a fragmentary front elevational view of the hook unit illustrated in FIG. 5.

FIGS. 5 and 6 show another specific constitutional example of each of the pair of hook units 13 and 13 of the suspended display apparatus 10 illustrated in FIGS. 1 and 2.

A hook unit 30 illustrated in FIGS. 5 and 6 comprises a rotary disc 32 mounted to the upper face of the case 11 by means of a screw 31 for angular movement about a central pivotal axis extending perpendicularly to the upper face of the case 11, and an engaging section 33 mounted to an upper face of the rotary disc 32.

Angular movement of the rotary disc 32 about the pivotal axis is restricted by engagement of a screw 34 with an arcuate slot **32*a* which is formed in the rotary disc 32** in concentric relation to the pivotal axis.

With the above arrangement, when the rotary disc 32 is moved angularly about the pivotal axis, the engaging section 33 mounted to the upper face of the rotary disc 32 is moved with respect to the upper face of the case 11 substantially toward and away from the front face thereof. Thus, the chain 15 is mounted to the engaging section 33 whereby there is obtained a desirable inclined angle of the display panel 12 of the suspended display apparatus 10.

Figure 7:
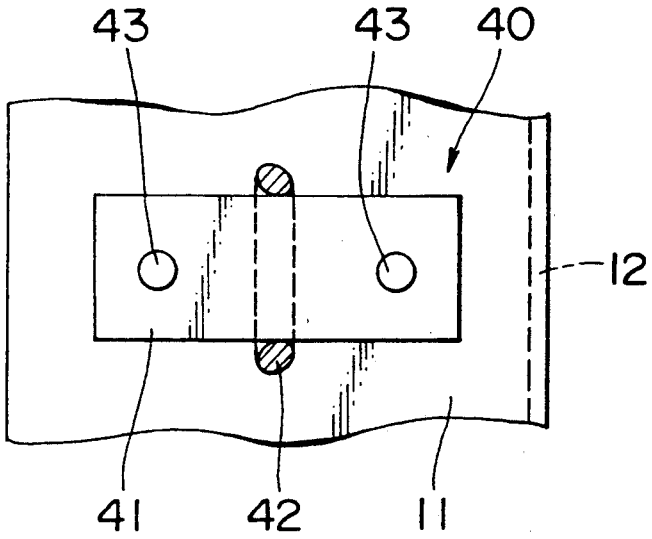
FIG. 7 is a view similar to FIG. 3, but showing still another constitutional example of the hook unit.
Figure 8:
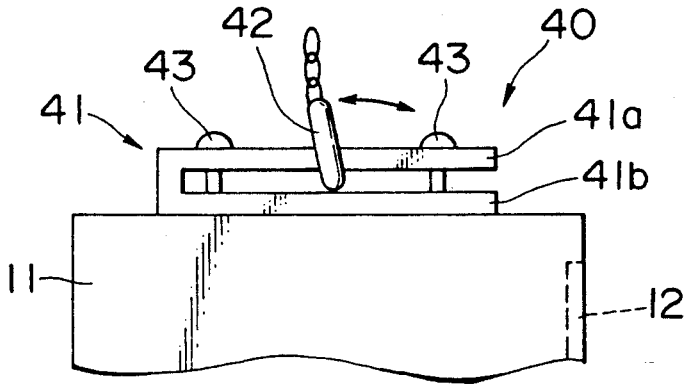
FIG. 8 is a fragmentary side elevational view of the hook unit illustrated in FIG. 7.

FIGS. 7 and 8 show still another specific constitutional example of each of the pair of hook units 13 and 13 of the suspended display apparatus 10 illustrated in FIGS. 1 and 2.

A hook unit 40 illustrated in FIGS. 7 and 8 comprises a clamp member 41 mounted to the upper face of the case 11, and a junction ring 42 whose part is clamped between a pair of clamp sections **41*a* and 41*b* of the clamp member 41 formed into a U-shaped cross-sectional configuration. The clamp sections 41*a* and 41*b* are spaced from each other in a direction along the front face of the case 11**.

The junction ring 42 can be swung, as indicated by the arrow in FIG. 8, substantially toward and away from the front face of the case 11 under such a condition that a pair of mounting screws 43 and 43 of the clamp member 41 are loosened. The mounting screws 43 and 43 are tightened at a suitable angular position of the junction ring 42, whereby the latter is fixedly mounted to the clamp member 41 at the angular position. Thus, the chain 15 is mounted to the junction ring 42 whereby there is obtained a desirable inclined angle of the display panel 12 of the suspended display apparatus 10.

In connection with the above, the clamp member 41 has the pair of clamp sections **41*a* and 41*b* which are integrally formed into the U-shaped cross-sectional configuration such that the clamp sections 41*a* and 41*b* are connected to each other at their respective one ends. However, the invention should not be limited to this specific example. The pair of clamp sections 41***a* and 41*b* may be formed by two separate plate elements.

Figure 9:
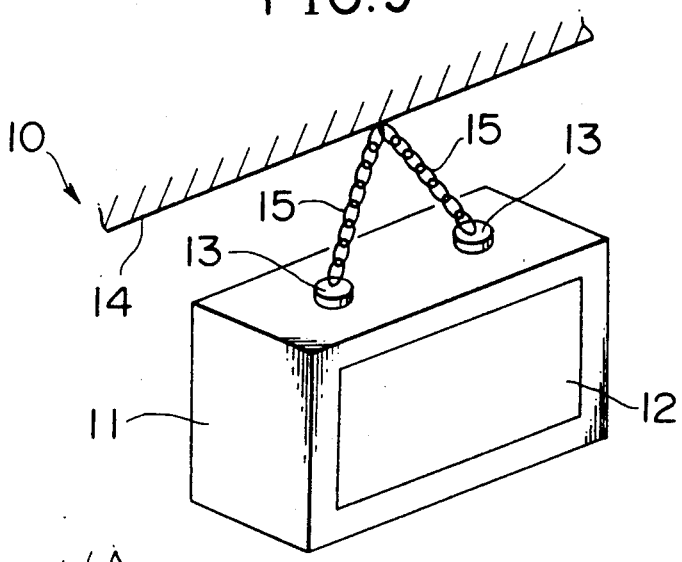
FIGS. 9 through 11 show various manners in which the suspended display apparatus illustrated in FIGS. 1 and 2 is suspended from the ceiling.
Figure 10:
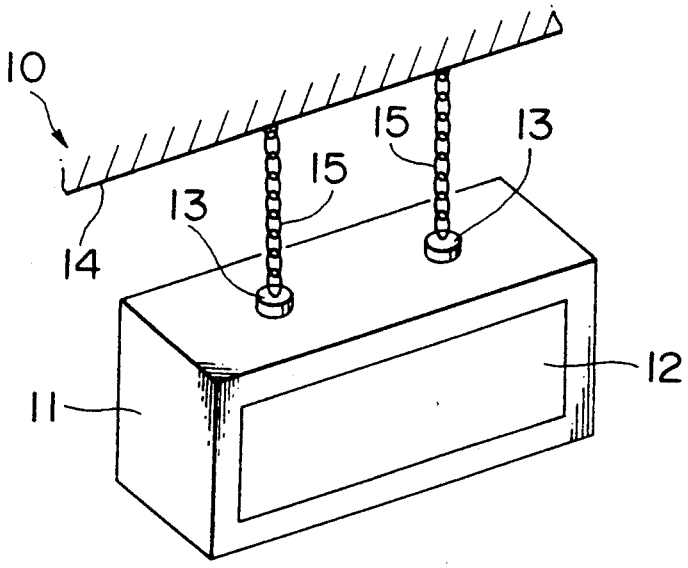
Figure 11:
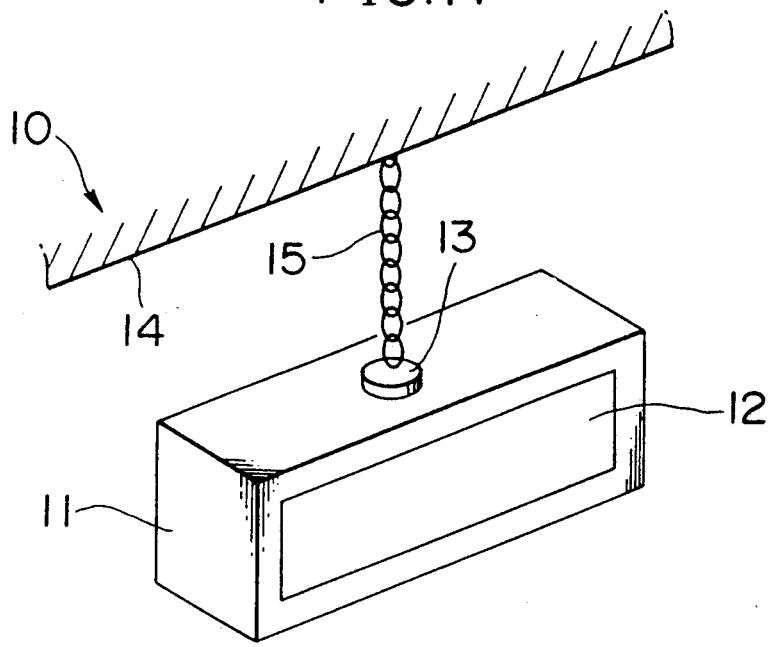

Referring to FIGS. 9 through 11, there are shown various manners in which the suspended display apparatus 10 illustrated in FIGS. 1 and 2 is suspended from the ceiling 14.

That is, in FIG. 9, the pair of chains 15 and 15 have their respective one ends which are anchored respectively to the pair of hook units 13 and 13. The other ends of the respective chains 15 and 15 are put together into one which is anchored to the ceiling 14.

Alternatively, as shown in FIG. 10, the pair of chains 15 and 15 extend substantially in parallel relation to each other, and the other ends of the respective chains 15 and 15 are anchored to the ceiling 14.

Alternatively, as shown in FIG. 11, a single chain 15 is utilized in place of the pair of chains 15 and 15 illustrated in FIGS. 1 and 2, or in FIG. 9, or in FIG. 10. The single chain 15 has its one end which is anchored to a single hook unit 13 mounted to the top of the case 11 for movement toward and away from the front face of the case 11. The other end of the single chain 15 is anchored to the ceiling 14.

What is claimed is:

1. A suspended display apparatus suspended from a predetermined position, comprising:

a case having a front face and an upper face;

a display panel supported substantially vertically by the front face of said case;

hook means mounted to the upper face of said case such that said hook means is movable toward and away from the front face of said case; and elongated suspending means having one end thereof fixedly mounted to said predetermined position, the other end of said elongated suspending means being engaged with said hook means, wherein said hook means includes a hook element having an intermediate section bent away from the upper face of the case, said elongated suspending means having, at its other end, an annular element which is engaged with said intermediate section of said hook element, said hook element, being formed with a pair of mounting bores elongated in a direction perpendicular to the front face of said case, said hook means further including a pair of threaded elements which are threadedly engaged with the upper face of said case respectively through said mounting bores.

2. A suspended display apparatus suspended from a predetermined position, comprising:

a case having a front face and an upper face;

a display panel supported substantially vertically by the front face of said case;

hook means mounted to the upper face of said case for movement toward and away from the front face of said case into selected adjusted positions;

means carried by said case for fixing said hook means in said selected adjusted positions; and elongated suspending means having one end thereof fixedly mounted to said predetermined position, the other end of said elongated suspending means being engaged with said hook means, whereby the inclination of the display panel may be adjusted;

said hooking means including a hook element having an intermediate section bent away from the upper face of the case, said elongated suspending means having, at its other end, an annular element which is engaged with said intermediate section of said hook element.

3. The suspended display apparatus according to claim 2, wherein said intermediate section of said hook element is formed into a reversed V-shaped configuration.

4. A suspended display apparatus suspended from a predetermined position, comprising:

a case having a front face and an upper face;

a display panel supported substantially vertically by the front face of said case;

hook means mounted to the upper face of said case for movement toward and away from the front face of said case into selected adjusted positions;

means carried by said case for fixing said hook means in said selected adjusted positions; and elongated suspending means having one end thereof fixedly mounted to said predetermined position, the other end of said elongated suspending means being engaged with said hook means, whereby the inclination of the display panel may be adjusted;

said hook means including a rotary disc movable angularly about its central pivotal axis, said rotary disc having an arcuate slot in concentric relation to said pivotal axis, said one end of said elongated suspending means being engaged with said rotary disc, said hook means further having a threaded element threadedly engaged with the upper face of said case through said arcuate slot.

5. A suspended display apparatus suspended from a predetermined position, comprising:

a case having a front face and an upper face;

a display panel supported substantially vertically by the front face of said case;

hook means mounted to the upper face of said case for movement toward and away from the front face of said case into selected adjusted positions;

means carried by said case for fixing said hook means in said selected adjusted positions; and elongated suspending means having one end thereof fixedly mounted to said predetermined position, the other end of said elongated suspending means being engaged with said hook means, whereby the inclination of the display panel may be adjusted;

said hook means having a pair of clamp elements spaced from each other in a direction along the front face of said case, said elongated suspending means having, at its other end, an annular element which is clamped between said pair of clamp elements, said hook means further having a pair of threaded elements threadedly engaged with the upper face of said case through said pair of clamp elements.

6. The suspended display apparatus according to claim 5, wherein said pair of clamp elements are formed integrally into a U-shaped cross-sectional configuration.

* * * * *